US005095716A

United States Patent [19]

You

[11] Patent Number: 5,095,716

[45] Date of Patent: Mar. 17, 1992

[54] AIR CONDITIONING APPARATUS

[75] Inventor: Hee S. You, Seoul, Rep. of Korea

[73] Assignee: Samsung Electronics Co., Ltd., Suweon, Rep. of Korea

[21] Appl. No.: 635,240

[22] Filed: Dec. 28, 1990

[30] Foreign Application Priority Data

Dec. 28, 1989 [KR] Rep. of Korea ..... P89-19873

[51] Int. Cl.[5] ..... F25D 23/10; F25B 39/04

[52] U.S. Cl. ..... 62/259.1; 62/238.6; 62/299; 62/507; 62/506; 62/508; 165/53; 165/56

[58] Field of Search ..... 165/56, 57, 53; 62/263, 62/259.1, 506, 507, 508, 238.6, 299

[56] References Cited

U.S. PATENT DOCUMENTS

| | | | |
|---|---|---|---|
| 2,462,557 | 2/1949 | Santee | 62/259.1 |
| 2,478,617 | 8/1949 | Anderegg | 62/507 |
| 2,509,294 | 5/1950 | Frueu | 62/508 |
| 2,667,763 | 2/1954 | Harris | 62/508 |
| 3,262,493 | 7/1966 | Hervey | 165/18 |
| 3,498,079 | 3/1970 | Kramer | 62/263 |
| 4,013,120 | 3/1977 | Rheinheimer | 165/56 |
| 4,501,128 | 2/1985 | Gallagher | 62/238.6 |
| 4,733,543 | 3/1988 | Blair | 62/263 |

*Primary Examiner*—Albert W. Davis, Jr.
*Attorney, Agent, or Firm*—Cushman, Darby & Cushman

[57] ABSTRACT

In a room air conditioner, at least the condenser, and preferably both the compressor and the condenser, are separated from the main body of the air conditioning apparatus, and are mounted in an exteriorly facing wall, outside the room which is to be cooled. The main body of the air conditioning apparatus is connected with compressor and condensor mounted in the wall by connecting piping and fittings and is mounted on the wall by a hanging bracket and position-fixing spacer bracket.

5 Claims, 2 Drawing Sheets

AIR CONDITIONING APPARATUS

BACKGROUND OF THE INVENTION

The present invention relates to air conditioning apparatus of the separated type, for cooling room air, and particularly to an air conditioning apparatus the main body of which can be simply manufactured, and the compressor and condenser of which can be easily mounted in a wall.

Air conditioning apparatus for cooling room air is classified into separated and integral types, all of which include compressing means, condensing means and evaporating means.

A typical example of an integral-type air conditioning apparatus is disclosed in U.S. Pat. No. 4,505,328. When a building or a house is built, an opening is made in an exteriorly facing wall of the building or the house. Air conditioning apparatus which comprises evaporating means, condensing means, compressing means, fan means and a motor is put in a cabinet, and the cabinet is mounted in the opening made in an exteriorly facing wall of the building or the house. However, air conditioning apparatus of the integral type is of great bulk and has a disadvantage in that the condensing means and motor are noisy.

In order to obviate these problems of integral-type air conditioning apparatus in the prior art, air conditioning apparatus has been separated into a set of indoor apparatus components including evaporating means, and a set of outdoor apparatus components including condensing means. The indoor apparatus is installed in the room and the outdoor apparatus is installed out of the room. Even though such a separated type apparatus conventionally has reduced the bulk, the user still has had difficulty in installation and, because the outdoor apparatus components are installed out of the room, the outdoor apparatus components require a space in which to be installed, and furthermore, such external installation spoils the overall appearance of the house or the building.

SUMMARY OF THE INVENTION

In order to solve these problems, at least the condensing means of the compressing means and condensing means of an air conditioning apparatus is separated from the main body of the air conditioning apparatus, and mounted within an exteriorly facing wall, i.e., facing the outside. The main body of the air conditioning apparatus is connected with compressing means and condensing means mounted in the wall by connecting members and is mounted on the wall by hanging means and fixing means.

Accordingly, it is an object of the present invention to prevent noise generated in compressing means of condensing means of a room air conditioner from being transferred to the interior of a room by separating these components from the main body of the air conditioner and mounting them in an exteriorly facing wall.

It is another object of the invention to eliminate the requirement for mounting the outdoor apparatus components of a separated-type air conditioner, in the outdoors.

It is another object of the present invention to make manufacturing and mounting of the main body of a separated-type air conditioner easy, by excluding condensing means and compressing means from it.

DETAILED DESCRIPTION OF THE INVENTION

A presently preferred embodiment of the invention will now be described in conjunction with the accompanying drawings.

Figure 1:
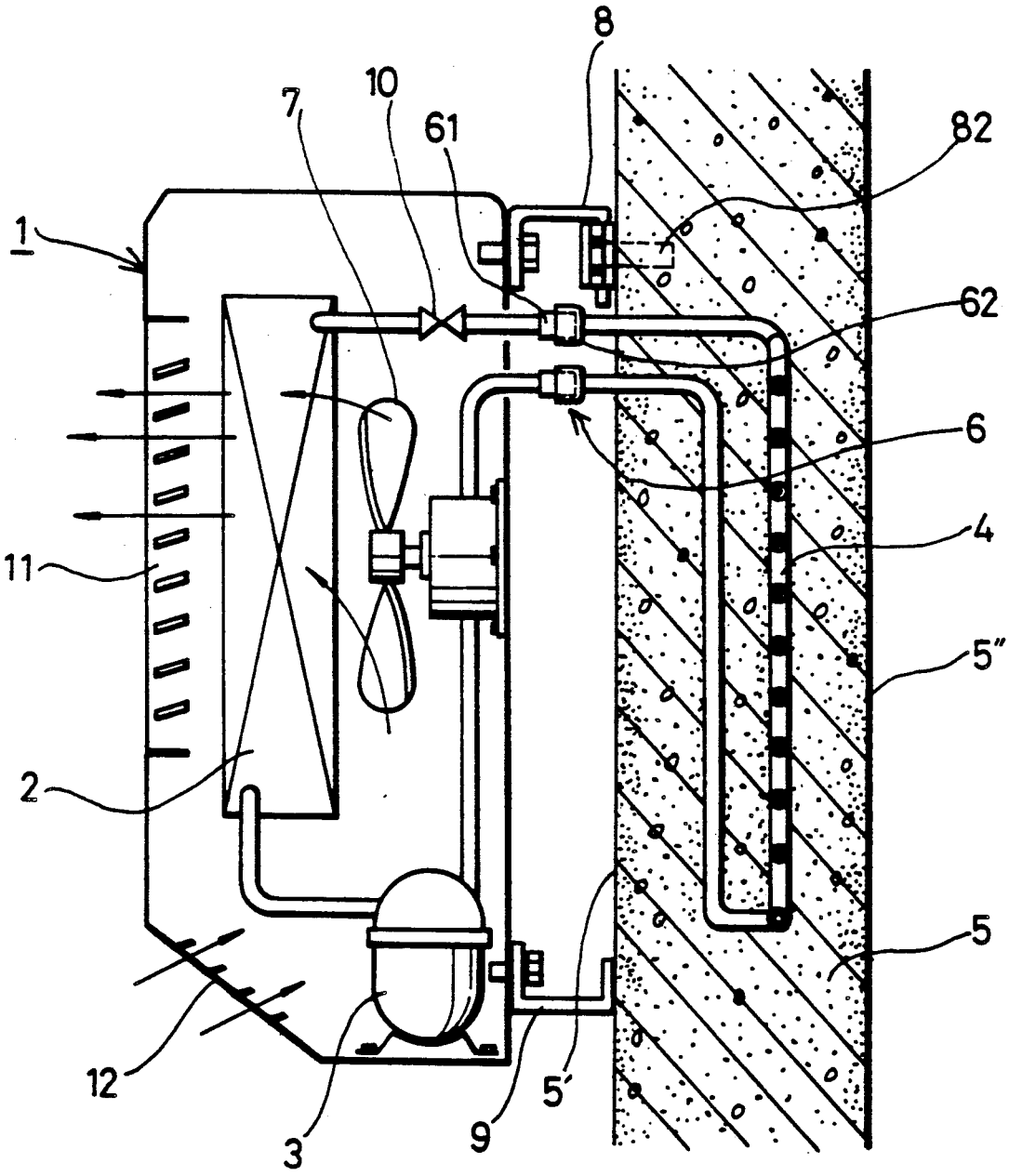
FIG. 1 is a longitudinal vertical cross-sectional view showing air conditioning apparatus according to a first embodiment of the present invention.

Air conditioning apparatus according to the invention is shown in FIG. 1. The apparatus includes a main body 1 which is mounted on the inside of a building wall 5, and the housing of the main body 1 has a rectangular form. An air discharging portion 11 is formed in the front face of the housing of the main body 1, and an air in-taking portion 12, for in-taking indoor air, is formed in the slanted bottom of the main body 1. Inside of the housing, an evaporating means 2 is installed behind the discharging portion 11, blowing means 7, e.g., a motor-operated fan, is installed behind the evaporating means 2, and a compressing means 3 is fixed on the horizontal bottom of the housing of the main body 1, e.g., by screws.

The evaporating means 2 is connected to the compressing means 3 by piping, and the evaporator, compressor and piping together form a part of a refrigeration cycle. The opposite side of the evaporating means 2 is connected with an expansion means 10. The expansion means 10 and the compressing means 3 are extended to the outside of the main body 1 with piping, so they project a predetermined length from the upper backside of the housing of the main body 1. The projecting ends of this piping are capable of being connected with condensing means mounted in the wall, by the connecting members 6. Also, hanging means 8 for hanging the main body 1 on the inside of the wall 5 are mounted on the left and right upper corners of the back of the main body 1, and distance-holding members 9 are mounted on the left and right lower corners of the back of the main body 1.

A condensing means 4 is embedded in the wall 5 and has screw-threaded fittings formed at its ends. These ends project out of the wall 5, on the indoor side, so that the condensing means can be connected via the connecting members 6, with the expansion means 10 and the compressing means 3. The condensing means 4 is made of pipe having a serpentine form. The condenser piping is laid parallel to the interior face 5″ of the wall 5 and occupies a prescribed rectangular area behind the wall face 5″. The laying interval between pipe runs is a predetermined length, and the pipe is embedded in the wall a distance that is 1.5 to 2.0 times the diameter of the pipe.

The air conditioning apparatus according to the invention comprises expansion means 10, evaporating means 2, compressing means 3 which are mounted in main body 1, condensing means 4 which are mounted in wall 5, main body 1, and connecting members 6 by which the main body 1 is connected with the condensing means 4. The evaporating means 2, the compressing means 3, the condensing means 4 and the expansion means 10 are connected with one another, so they make refrigeration cycle. In the expansion means 10, coolant expands, so it changes to liquid of low temperature and high pressure. In the evaporating means 2, coolant absorbs heat, so it changes from liquid to gas. Coolant is supercooled and absorbs heat in the air surrounding the evaporating means 2, so the temperature of the air falls. Indoor air is in-taken in the inner side of the main body 1 by the blowing means 7 mounted on the backside of the evaporating means 2. The in-taken indoor air is heat-exchanged through the evaporating means 2, and then it is discharged to the room.

As described above, the air conditioning apparatus according to the invention circulates and cools indoor air in a room with forced convention.

The connecting members 6 comprise a pair of sockets 62 and nipples 61. The socket 62 is a nut having the form of a hexagon, and is coupled with the projected end of the condensing means 4 from wall face 5'. Because the nipple has a screw thread on the exterior face, which is coupled with socket 62, the socket 62 and the nipple 61 are coupled together by their own screw threads.

The wall hanging member 8 is mounted on the backside of main body 1. The wall hanging member 8 is an angle bracket having the form of a "[". One side of the angle is fixed to the backside of the main body 1 by bolts; the other side of the angle has holes which are coupled with the hanging member 82 by nuts. One end of the hanging member 82 projects out of the indoor side of the wall 5 and other end of it is embedded in the wall 5.

A distance-holding member 9 having the same thickness as the wall hanging member 8 is fixed to the backside of the main body 1 by bolts, and the gap between the wall 5 and the main body 1 is adjusted by tightening the bolts.

In use, a gaseous coolant at high pressure and high temperature flows from the compressing means 3 to the condensing means 4, and radiates heat to the outdoor air during its passage through the condensing means 4, thereby becoming a liquid coolant at a lower temperature and high pressure.

As described above, the condensing means 4 transfers heat to the wall 5, which, typically, is made of concrete, and the heat absorbed by the wall 5 is transferred in all directions along the wall 5. However, because wall surface 5' on the indoor side is preferably covered with an insulating member, heat is not transferred to the indoor side. Because heat conductivity of concrete is as low as $2\times10^{-4}$ kcal/sec.m.°C., the heat transferred to the wall is relatively small in amount and most of the heat is radiated to the atmosphere.

Coolant, being gaseous in the evaporating means 2, flows to the compressing means 3 due to pumping of the compressor. In the compressing means 3, coolant is compressed by the compressing means 3, so it changes to gas in high temperature and high pressure.

Gaseous coolant at high temperature and high pressure transfers heat to the wall 5, and the gaseous coolant changes to liquid at a lower temperature, and high pressure. The wall 5 radiates heat to atmosphere by radiation and convection.

Refrigeration capacity of a normal air conditioning apparatus is 2,240 kcal/h. When the heat radiated per hour through the wall surface 5" in which the condensing means 4 is embedded is equal to the refrigeration capacity of conventional air conditioning apparatus, the wall area which the condensing means occupies is calculated as follows:

The amount of heat radiated from the wall is related to pipe-embedding depth and pipe laying space. It is desired that pipe-embedding depth be 1.5 to 2.0 times the pipe's diameter, and pipe laying space be 3 cm, in the preferred embodiment.

The equation obtained by experimentation is $$Q=K*A*(tp-t)\text{kcal/h}$$

$$\frac{1}{K}=\frac{a+b}{\lambda_o}\ \text{kcal/h},$$

wherein, tp = the surface temperature of the pipe, t = the temperature of exterior wall surface (normally, tp − t = 5° C.), A = the area for radiating heat, a = the distance between the exterior wall surface and the exterior diameter of the pipe, b = the pipe laying space, and $\lambda_o$ = the heat conductivity of concrete (1.1 kcal/h).

The external diameter of the pipe 5 is ½ inch, in the preferred embodiment. Solving the above equations on conventional air conditioning apparatus of 2,240 kcal/h, one obtains the following solution:

$$\frac{1}{K}=\frac{3*10^{-2}\ \text{m}+3*10^{-2}\ \text{m}}{1.1\ \text{kcal/m}\cdot\text{h}\cdot{}^\circ\text{C.}}=\frac{1}{18.3\ \text{kcal/m}^2\cdot\text{h}\cdot{}^\circ\text{C.}}$$

$$K=18.3\ \text{kcal/m}^2.\text{h.}^\circ\text{C.}$$

$$2{,}240\ \text{kcal/h}=(18.3\ \text{kcal/m}^2.\text{h.}^\circ\text{C.})*A*(5^\circ\ \text{C.})$$

$$\therefore A=25\ \text{m}^2$$

Therefore, when the air conditioning apparatus according to the invention has a refrigeration capacity of 2,240 kcal/h, its condensing means is installed in a way that it is 3 cm in depth, pipe laying space is 3 cm and it takes area 5 m in width and 5 m in length of wall surface.

To improve heat radiation capacity of condensing means, the person of ordinary skill in the art related to the invention understands well that the condenser should be installed in an area that is larger than the area calculated above.

Figure 2:
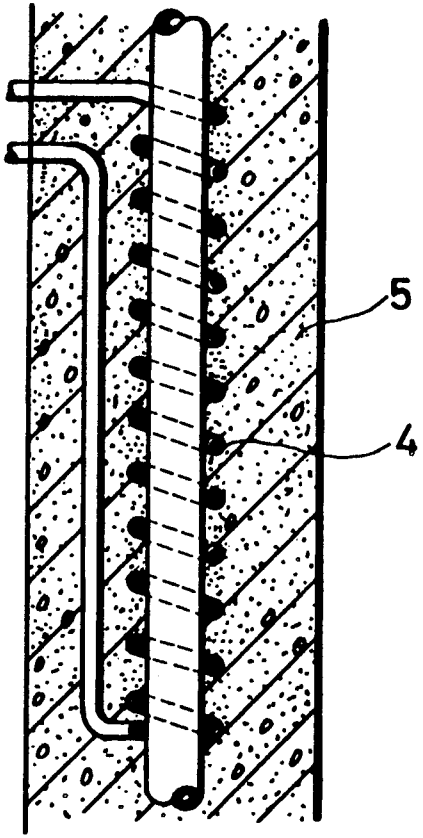
FIG. 2 is a fragmentary cross-sectional view showing air conditioning apparatus according to a second embodiment of the present invention.

As shown in FIG. 2, when the air conditioning apparatus of the invention is implemented with the pipe of condensing means 4 wound on other piping members (a water pipe, etc.), it has an improved heat efficiency, because it is then able to radiate heat through the other piping members.

Figure 3:
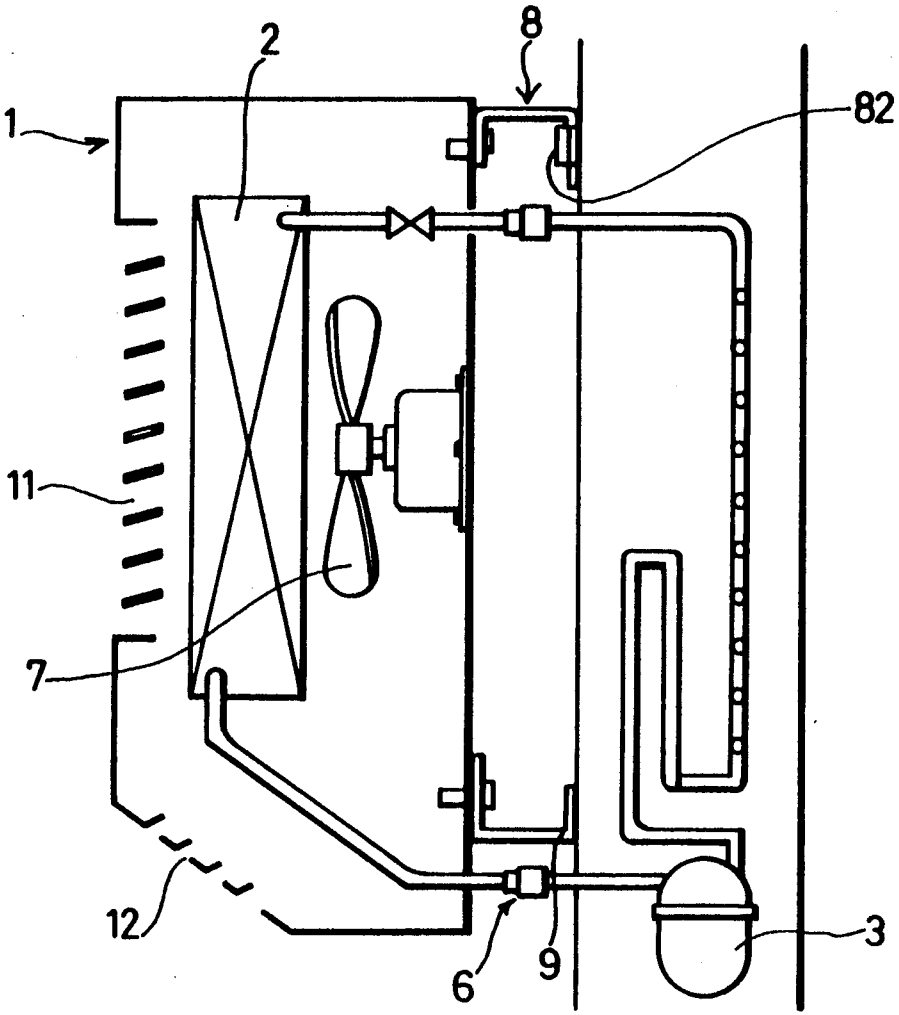
FIG. 3 is a longitudinal vertical cross-sectional view showing air conditioning apparatus according to a third embodiment of the present invention.

Another embodiment of the apparatus of the present invention is shown in FIG. 3. In the FIG. 3 embodiment, the compressing means 3 and the condensing means 4 are separated from the main body 1 and embedded in the wall 5. Because the compressing means 3 is as thick as the wall 5, it cannot be installed in the wall 5 in the same way as is the condensing means 4. Accordingly, an opening having a predetermined depth is made in the wall 5, which opening is closed towards the indoor side and open towards the outdoor side. The wall surface 5" is finished with a covering member which makes it look good. Two ends extended from the devices in the main body 1 project to a predetermined length in the backside of it. They each connect with the condensing means 4 and the compressing means 3.

The air conditioning apparatus, according to the invention, has advantage in that, because compressing means and condensing means are separated from main body and mounted in a wall, its exposed volume is reduced, and the room is screened from noise generated by the compressing means and condensing means, by the wall, and the apparatus has a high heat efficiency.

What is claimed is:

1. An air conditioning system for a room of a building, comprising:

a building wall having two opposite sides, including one side facing a room interior and another side facing exteriorly, said wall being of a given thickness between said sides;

an air conditioning apparatus comprising an evaporator operatively connected by piping in a circuit with an expansion means, a condenser and compressor;

a housing;

said evaporator, said expansion means being mounted in said housing, together with some of said piping;

means hangingly mounting said housing on said wall so that said housing is disposed within said room interior and spaced a predetermined distance forwardly of said one side of said wall;

said condenser being embedded in said wall intermediate said one and other sides of said wall;

portions of said piping, leading to and from said condenser projecting out of said wall through said one side and being connected, forwardly of said one side of said wall, by respective connectors, to portions of said piping leading to said expansion means and from said evaporating means;

said compressing means being interposed in said circuit by said piping and located in one of said housing and said wall;

said condenser including coils of pipe disposed in a heat exchange relationship with material of said wall outside said room, for radiation through said other side of said wall to exteriorly of said room.

2. The air conditioning system of claim 1, wherein:

said wall further incorporates water pipe means embedded therein for carrying water; and at least some of said coils of pipe of said condenser are wound about said water pipe means, so as to be disposed in heat exchanging relationship therewith.

3. The air conditioning apparatus of claim 1, wherein:

said compressing means is disposed in an externally opening recess in said wall so as to be accessible through said other side of said wall from externally of said room.

4. The air conditioning apparatus of claim 1, wherein:

said means for hangingly mounting said housing on said wall include a hanger partly embedded in the wall and projecting out into said room through said one side of said wall; a bracket hung on said hanger; and a spacer located distally of said bracket and engaged between said housing and said one side of said wall.

5. The air conditioning apparatus of claim 1, wherein:

said housing further includes an air inlet, an air outlet, and a fan arranged to draw room air in through said inlet, and blow said air across said evaporating means and back out into said room through said air outlet.

* * * * *